US010323549B2

(12) United States Patent
Luciano

(10) Patent No.: US 10,323,549 B2
(45) Date of Patent: Jun. 18, 2019

(54) SELF-ALIGNING ROCKER ARM AND PUSHROD DESIGN

(71) Applicant: Progress Rail Locomotive Inc., LaGrange, IL (US)

(72) Inventor: Michael F. Luciano, Hanover Park, IL (US)

(73) Assignee: Progress Rail Locomotive Inc., LaGrange, IL (US)

( * ) Notice: Subject to any disclaimer, the term of this patent is extended or adjusted under 35 U.S.C. 154(b) by 17 days.

(21) Appl. No.: 15/643,592

(22) Filed: Jul. 7, 2017

(65) Prior Publication Data

US 2019/0010836 A1 Jan. 10, 2019

(51) Int. Cl.
*F01L 1/18* (2006.01)
*F01L 1/047* (2006.01)
*F01L 1/14* (2006.01)

(52) U.S. Cl.
CPC ..... *F01L 1/185* (2013.01); *F01L 1/047* (2013.01); *F01L 1/146* (2013.01)

(58) Field of Classification Search
CPC ..... F01L 2001/0476; F01L 1/146; F01L 1/18; F01L 1/181; F01L 1/46; F01L 2105/00
USPC ..... 123/90.39, 90.44, 90.61
See application file for complete search history.

(56) References Cited

U.S. PATENT DOCUMENTS 5,588,413 A 12/1996 Stone et al.
5,642,692 A * 7/1997 Wride ..... F01L 1/18 123/90.16
2015/0021508 A1 1/2015 Nair et al.
2015/0377082 A1 12/2015 Rasmussen et al.
2016/0069222 A1* 3/2016 Young ..... F01L 1/18 123/90.39
2016/0138436 A1* 5/2016 Young ..... F01L 1/181 123/90.39

* cited by examiner

*Primary Examiner* — Jorge L Leon, Jr.
(74) *Attorney, Agent, or Firm* — Law Office of Kurt J. Fugman LLC

(57) ABSTRACT

A rocker arm may comprise a body defining a pivot aperture and include a pad spaced away from the pivot aperture a predetermined distance. The pad may include a peripheral surface and a top surface that defines a blind aperture, forming an intersection therewith, and the top surface may include a plurality of aligning features disposed around the blind aperture.

17 Claims, 9 Drawing Sheets

SELF-ALIGNING ROCKER ARM AND PUSHROD DESIGN

TECHNICAL FIELD

The present disclosure relates generally to rocker arms that are used in engines that mate with other components such as pushrods in order to move other components of the engine. More specifically, the present disclosure relates to a self-aligning rocker arm and pushrod design wherein the rocker arm has features that guide the pushrod or other component that mates with the rocker arm to stay functionally engaged with the rocker arm.

BACKGROUND

Many engines, including diesel engines used by locomotives and the like, using valve trains to control the timing of the opening and closing of intake and/or exhaust valves. As can be imagined, the timing of opening or closing these valves is important to make the engine run properly. These valve trains may use a cam shaft that actuates a cam follower rocker arm that moves a pushrod up and down, which in turn, causes one end of an overhead rocker arm to move up and down. This creates a rocking motion of the overhead rocker arm so that the other end opposite the end engaged by the pushrod, also moves up and down. This end of the overhead rocker arm may move a valve member so that the valve member opens and closes at the appropriate time.

As can be imagined, such valve trains are assembled to create the engine or after maintenance has been performed on the engine and/or valve train. During the assembly process, the pushrod is typically seated or otherwise mated to a surface of a depression of a rocker arm. Once properly aligned, bolts are torqued on a rocker bridge member that keeps the rocker arm, pushrod, and other components of the valve train in place.

However, in some instances, the pushrod is not always completely properly seated on the pad or button of the rocker arm when the bolts are torqued. As a result, the pushrod may slide off the rocker arm or may be bent as the bolts are torqued as an unintended compressive load is applied to the pushrod. In some cases, the portion of the rocker arm contacting the pushrod may also become damaged. This may cause the engine to malfunction or be damaged further once the engine is turned on, etc.

Accordingly, it is desirable to develop an apparatus and/or method to help prevent improper assembly of the valve train such that the pushrod is properly mated or aligned with a feature of a rocker arm.

SUMMARY OF THE DISCLOSURE

A rocker arm according to an embodiment of the present disclosure for use with train assembly of an engine is provided. The rocker arm may comprise a body defining a pivot aperture and including a pad spaced away from the pivot aperture a predetermined distance. The pad may include a peripheral surface and a top surface that defines a blind aperture, forming an intersection therewith, and the top surface may include a plurality of aligning features disposed around the blind aperture.

A valve train assembly according to an embodiment of the present disclosure is provided. The valve train assembly may comprise a cam follower rocker arm including a body that comprises a large eye portion defining a pivot aperture and a pad spaced away from the pivot aperture a predetermined distance, a small eye portion disposed underneath the pad, and the small eye portion defines a roller aperture. The pad may include a peripheral surface and a top surface that defines a blind aperture forming an intersection therewith, and the top surface includes at least one aligning feature disposed around the blind aperture. The pad includes an oblong shape with a major axis and a minor axis, the pivot aperture defines a pivot axis that is parallel with the minor axis and the major axis is perpendicular to the pivot axis, and the pad defines a maximum width measured along the major axis. The blind aperture defines a diameter measured along the major axis and the body defines a ratio of the maximum width to the diameter ranging from 2.3 to 2.9. The valve train further comprises a first shaft disposed in the pivot aperture, a roller disposed in the roller aperture, an overhead follower rocker arm including a first end, a second end, and a pivot feature located between the first end and the second end, a second shaft engaging the pivot feature of the overhead follower rocker arm, a pushrod including a bottom end engaging the pad and a top end engaging the first end of the overhead follower rocker arm, and a valve bridge assembly engaging the second end of the overhead follower rocker arm.

A method of assembly for a train assembly using a rocker arm according to an embodiment of the present disclosure is provided. The method may comprise engaging a pushrod with an aligning feature of a rocker arm or an aperture of the rocker arm, and limiting the movement of the pushrod relative to the rocker arm so that the pushrod is always in contact with an aligning feature of the rocker arm or an aperture of the rocker arm.

It should be noted that in FIGS. 5 thru 8, two positions of the same pushrod are illustrated engaging the pad of the cam follower rocker arm. The purpose of showing these two positions of the pushrod is to illustrate the principles of how proper alignment of the pushrod with respect to a rocker arm is maintained during assembly and operation of the valve train assembly. However, the reader should understand that only one pushrod per rocker arm is actually utilized.

Figure 9:
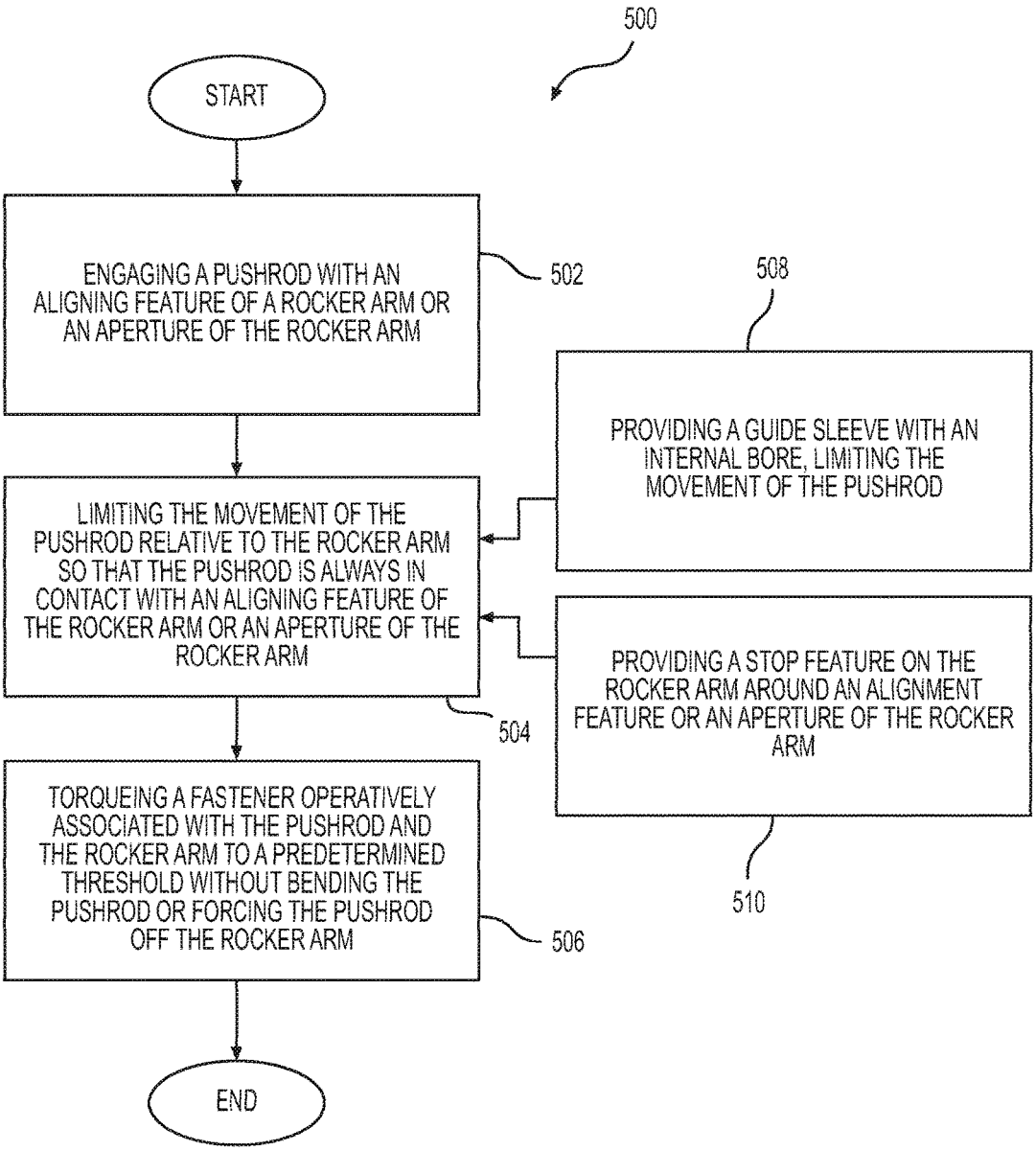

FIG. 9 contains a flowchart depicting a method of assembly for a valve train using a rocker arm according to an embodiment of the present disclosure.

DETAILED DESCRIPTION

Reference will now be made in detail to embodiments of the disclosure, examples of which are illustrated in the accompanying drawings. Wherever possible, the same reference numbers will be used throughout the drawings to refer to the same or like parts. In some cases, a reference number will be indicated in this specification and the drawings will show the reference number followed by a letter for example, 100*a*, 100*b* or a prime indicator such as 100', 100" etc. It is to be understood that the use of letters or primes immediately after a reference number indicates that these features are similarly shaped and have similar function as is often the case when geometry is mirrored about a plane of symmetry. For ease of explanation in this specification, letters or primes will often not be included herein but may be shown in the drawings to indicate duplications of features discussed within this written specification.

A method for assembling a valve train assembly, the resulting valve train assembly, and rocker arm having aligning features that may be used with such valve train assemblies or other train assemblies of an engine will now be described. While the application discussed herein is primarily for the valve train assembly of a diesel engine used by locomotives, it is to be understood that in other embodiments the engine may be any type of internal combustion engine and the train assembly may be used to control the movement of other engine components such as fuel injectors, etc. Also, the rocker arm herein may be used in any situation where a rocker arm is employed regardless of whether it is moved by a cam shaft directly or indirectly, etc.

Figure 1:
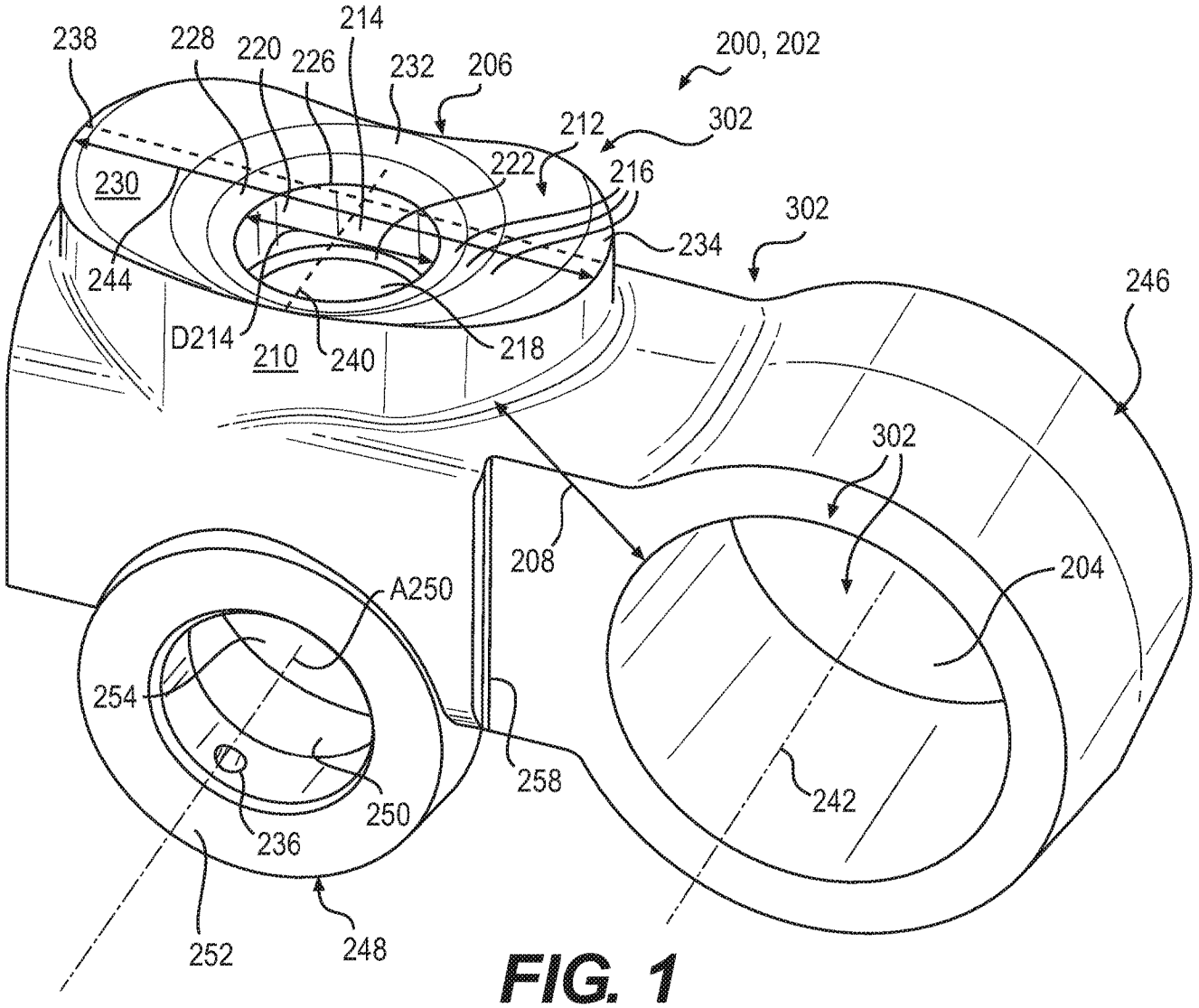
FIG. 1 is a perspective view of a rocker arm with self-aligning features according to an embodiment of the present disclosure after being finished by machining.
Figure 3:
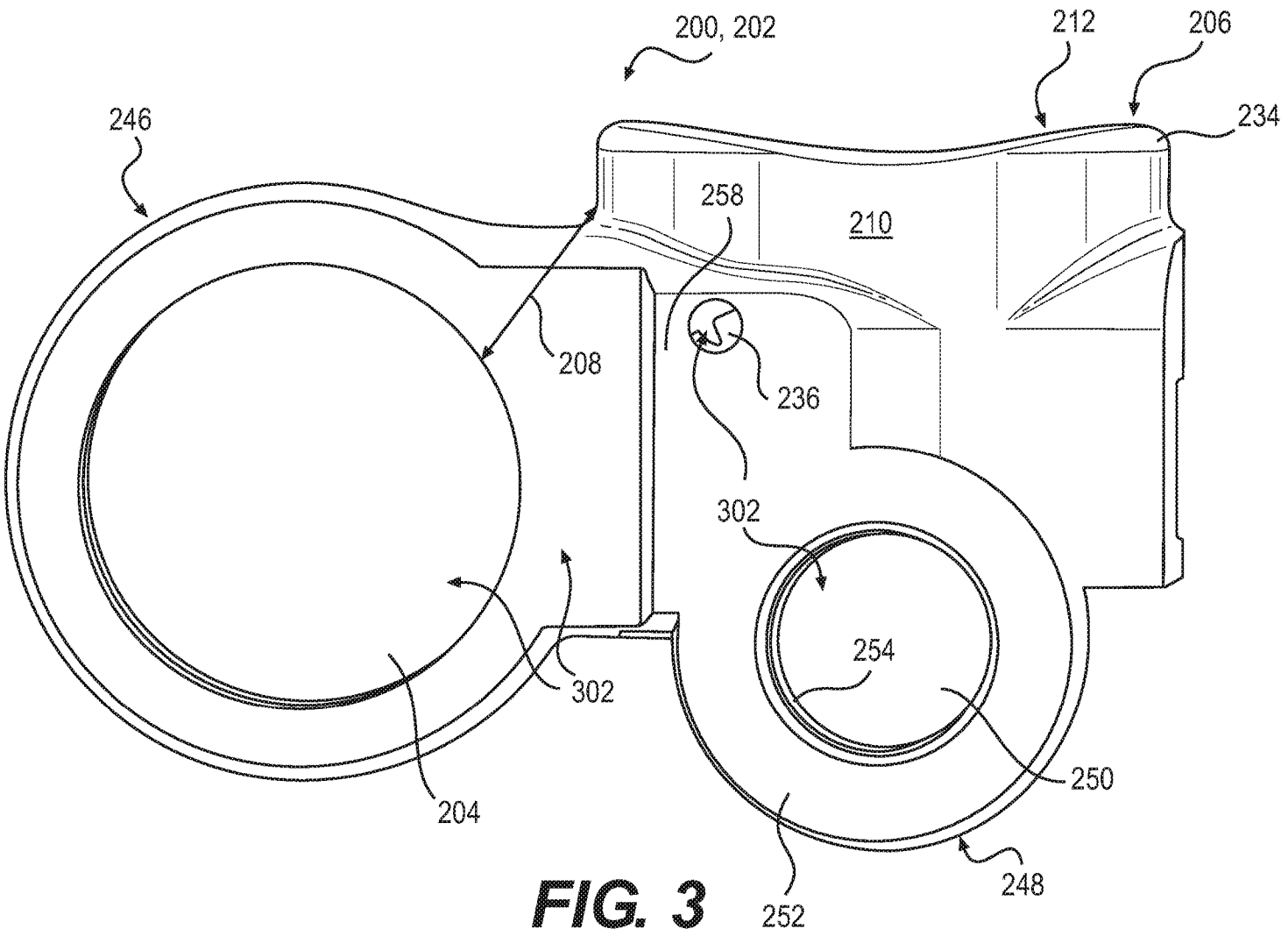
FIG. 3 is a rear oriented perspective view of the rocker arm of FIG. 1.
Figure 4:
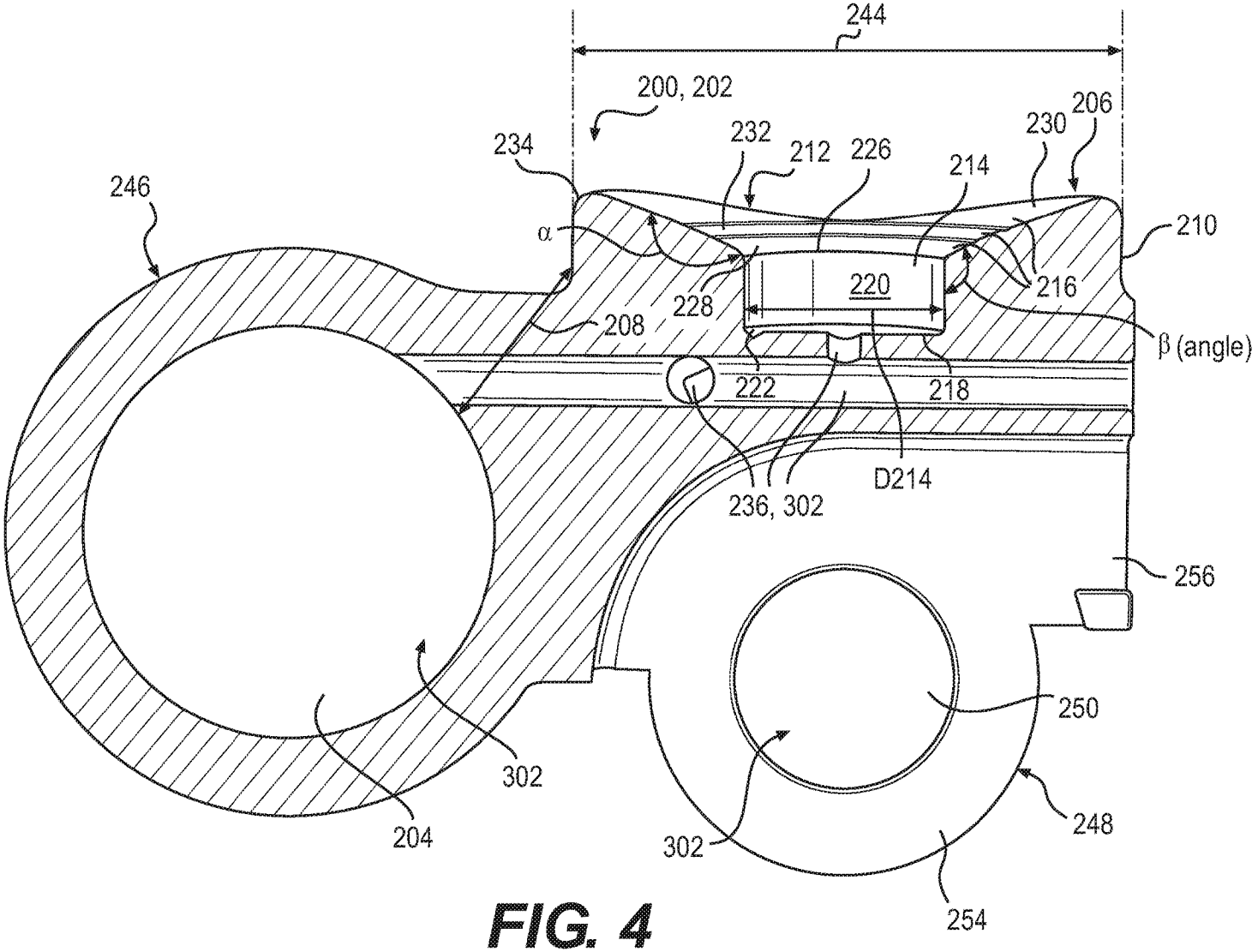
FIG. 4 is a sectional view of the rocker arm of FIG. 3 taken along a midplane of the rocker arm, revealing the lubrication bores and self-aligning features of the rocker arm more clearly.

Referring now to FIGS. 1, 3 and 4, a rocker arm 200 having aligning features according to an embodiment of the present disclosure will now be described. The aligning features are so called as these features bias a pushrod or other similar component toward a seating feature such as an aperture of the rocker arm and usually form an oblique angle with the sidewall or axis of an aperture of the rocker arm as will be described momentarily. The rocker arm 200 may comprise a body 202 that defines a pivot aperture 204 and includes a pad 206 (may also be referred to as a button, cup or seat portion) spaced away from the pivot aperture 204 a predetermined distance 208. The pad 206 may include a peripheral surface 210 and a top surface 212 that defines a blind aperture 214, forming an intersection therewith, and the top surface 212 may include at least one aligning feature 216.

For many embodiments, a plurality of aligning features 216 are provided that are disposed near and around the blind aperture 214. The pad 206 further may further include a bottom flat surface 218 disposed at the bottom of the blind aperture 214 and a cylindrical sidewall 220 extending from the bottom flat surface 218 to the top surface 212 of the pad 206. A groove 222 may be provided at the intersection of the bottom flat surface 218 and the cylindrical sidewall 220 for various reasons such as to avoid corner interference with the end of a pushrod or other similar component or the distribution of lubrication at the joint formed between the pushrod or other similar component and the rocker arm.

Figure 7:
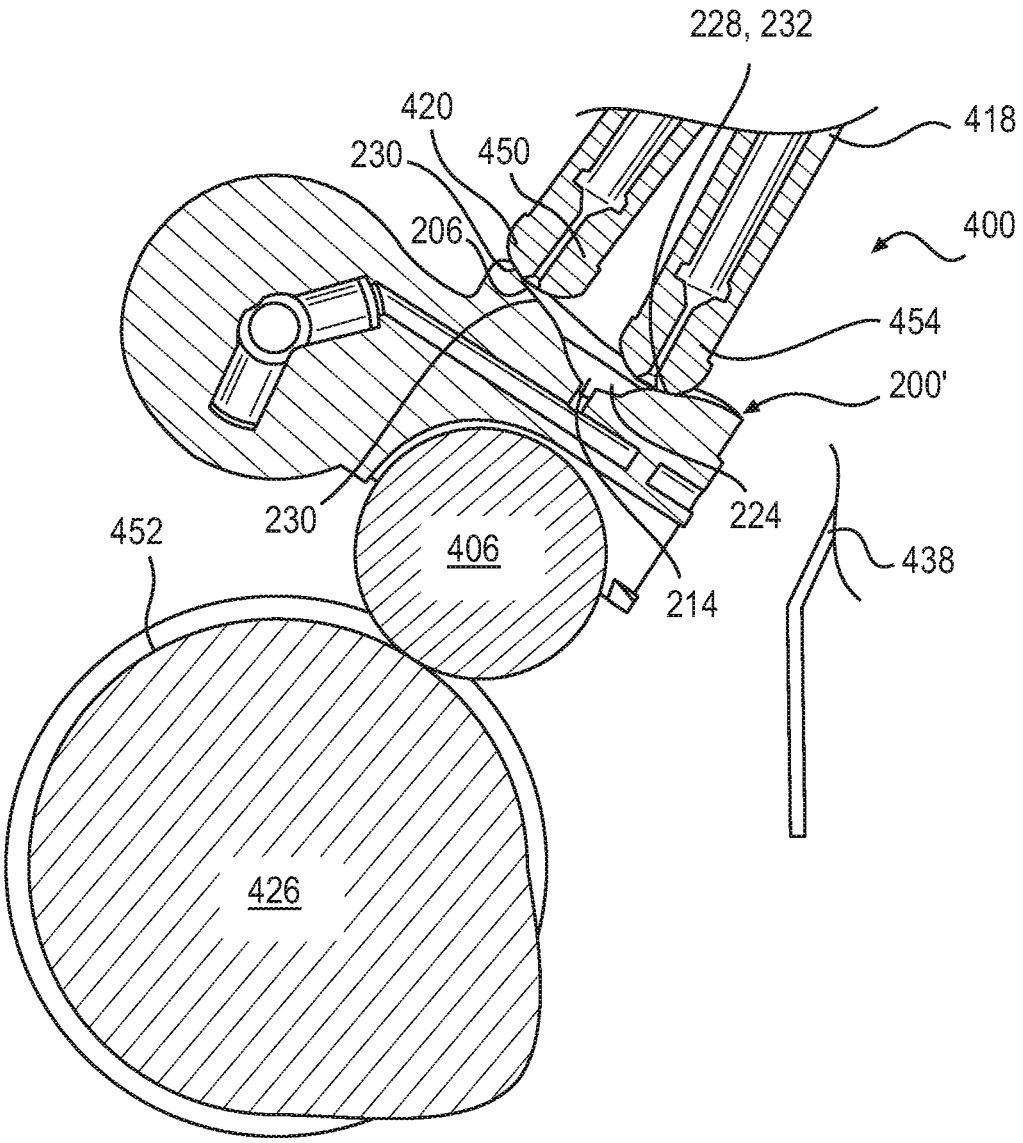
FIG. 7 is a sectional view of the valve train assembly of FIGS. 5 and 6 showing the extreme positions of the pushrod as the pushrod contacts the self-aligning features of the rocker arm when the roller attached to the rocker arm contacts with the base circle portion of the cam shaft of the valve train assembly.
Figure 8:
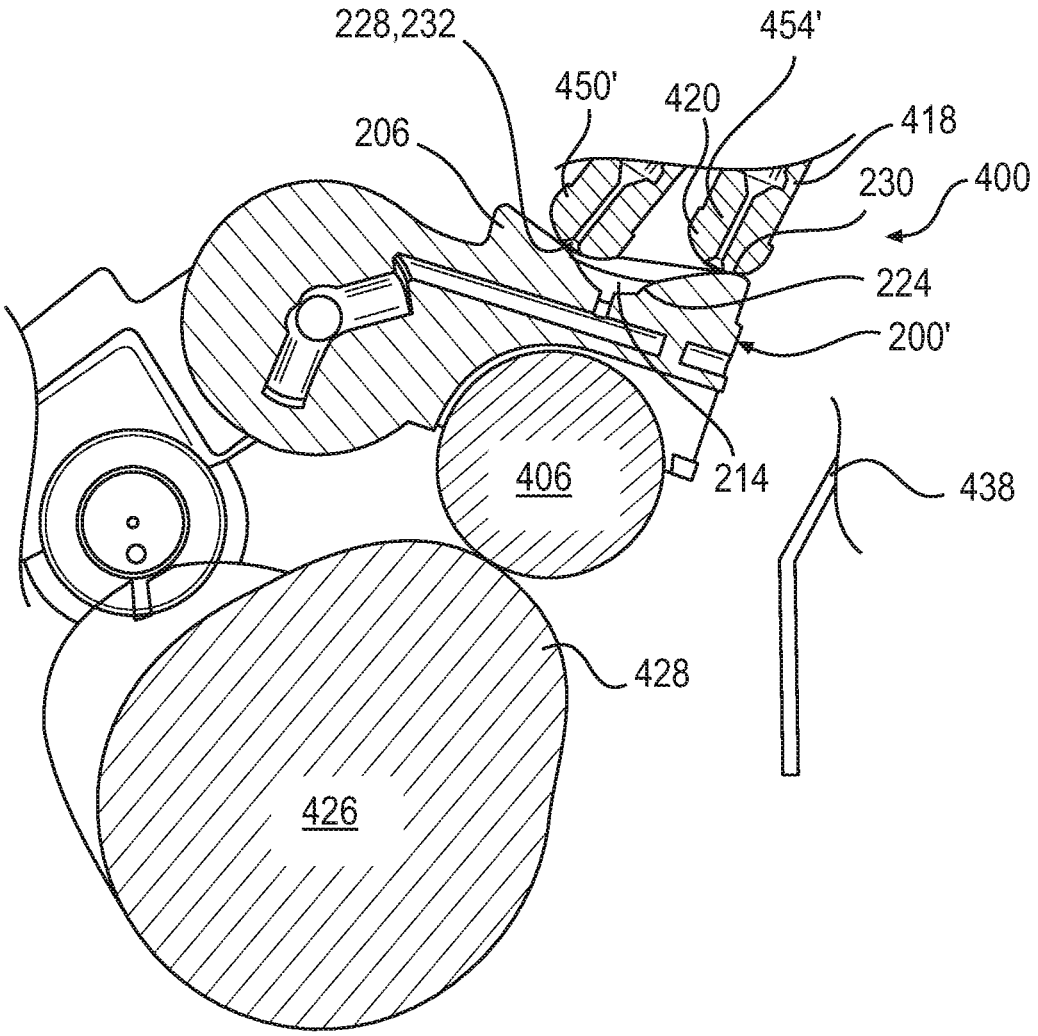
FIG. 8 is a sectional view of the valve train assembly of FIGS. 5 and 6 showing the extreme positions of the pushrod as the pushrod contacts the self-aligning features of the rocker arm when the roller attached to the rocker arm contacts a lobe over the cam shaft of the valve train assembly.

In other embodiments such as those shown in FIGS. 7 and 8, the pad 206 may include a concave surface 224 defining the blind aperture 214 such that a distinct sidewall or bottom surface does not exist. Such a concave surface 224 may be a radial surface that is configured to match complimentarily a convex surface at the end of a pushrod or other similar component. Other than this difference, the pad 206 of the rocker arm 200' of FIGS. 7 and 8, and the rocker arm 200' in general, may be similarly or identically configured to the rocker arm 200 of FIGS. 1, 3 and 4.

As best seen in FIGS. 1 and 4, the blind aperture 214 defines a perimeter 226 at the intersection of the blind aperture 214 with the top surface 212 of the pad 206 and the plurality of aligning features 216 includes a first chamfered surface 228 extending from the perimeter 226 of the blind aperture 214 towards the peripheral surface 210 of the pad 206. The plurality of aligning features 216 may further include a second chamfered surface 230 extending substantially from the peripheral surface 210 of the pad 206 (a small radius 234 may be provided to transition from the peripheral surface to the second chamfered surface) toward the first chamfered surface 228, forming an oblique angle $\alpha$ with the first chamfered surface 228 (see FIG. 4). Focusing on FIG. 4, this oblique angle $\alpha$ may range from 160 to 180 degrees and may be approximately 170 degrees in certain embodiments. Also, the first chamfered surface 228 may form an obtuse angle $\beta$ with the sidewall 220. This angle $\beta$ may range from 110 to 120 degrees and may be approximately 115 degrees in certain embodiments. The plurality of aligning features 216 may further include a radial surface 232 transitioning from the first chamfered surface 228 to the second chamfered surface 230.

With continued reference to FIGS. 1, 3 and 4, the rocker arm 200 may include a plurality of lubrication bores 236 for distributing lubrication to areas where joints are formed with other components such as shafts and pushrods, etc. The pad 206 may include a generally elliptical or oblong shape with a major axis 238 and a minor axis 240 (see FIG. 1). The pivot aperture 204 may define a pivot axis 242 that is parallel with the minor axis 240 and the major axis 238 is perpendicular to the pivot axis 242 and the minor axis 240. The pad 206 defines a maximum width 244 measured along the major axis 238 and the blind aperture 214 defines a diameter D214 measured along the major axis 238 and the ratio of the maximum width 244 to the diameter D214 may range from 2.3 to 2.9 and may be approximately 2.6 in some embodiments.

As best seen in FIG. 1, the rocker arm 200 may further comprise a large eye portion 246 defining the pivot aperture 204 and a small eye portion 248 disposed underneath the pad 206. That is to say, the small eye portion 248 may define a roller aperture 250 with an axis of rotation A250 and the cylindrical axis A214 of the blind aperture 214 of the pad 206 intersects axis A250, being perpendicular thereto. The small eye portion 248 may be split forming a first ring portion 252 and a second ring portion 254 on opposite sides of the rocker arm 200 separated by a cavity 256 (see FIG. 4), both of which may define a roller aperture 250 that extends through both the first ring and the second ring portions 252, 254.

Figure 2:
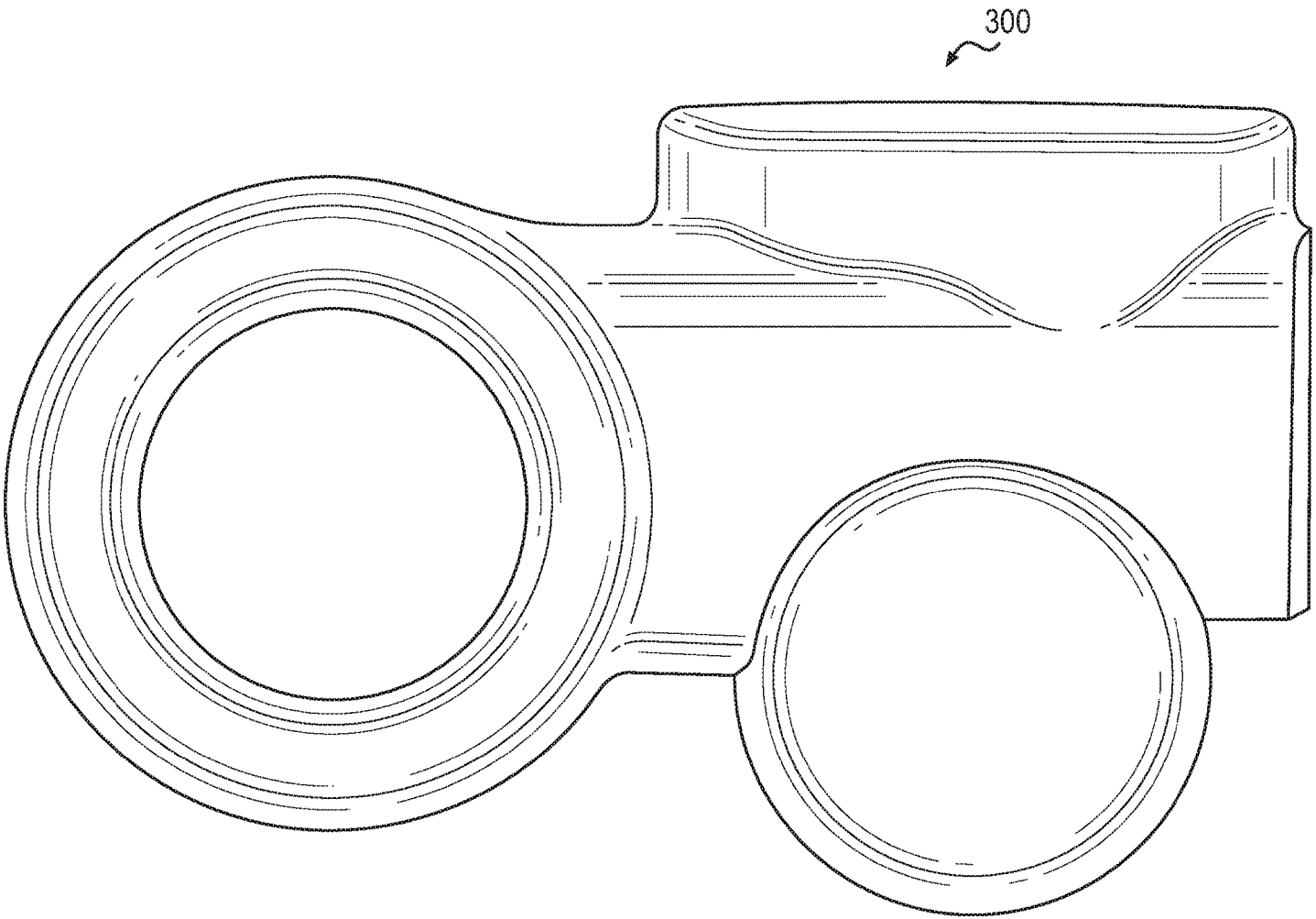
FIG. 2 is a rear view of a forging of a rocker arm used to create the rocker arm of FIG. 1 before being machined.

Referring now to FIG. 2, a forged blank 300 used to create the rocker arm 200 of FIG. 1 can be seen. As shown, the forged blank 300 lacks some finished dimensions and features created by machining the forged blank 300. The machined features 302 are shown in FIGS. 1, 3 and 4 and include the pad 206 and its peripheral surface 210, top surface 212, blind aperture 214, aligning features 216, various blending radii, the roller aperture 250, cavity 256, etc. Also, a step 258 may be machined to form the width of the large eye portion, measured along the pivot axis 242 so that when one rocker arm is contacting another adjacent rocker arm as they are inserted onto a shaft, these machined surfaces touch, accurately controlling the stack up dimensions of the plurality of adjacent rocker arms. The material used to make the forged blank 300 may be any suitable material such as steel, iron, grey cast iron, etc.

Figure 5:
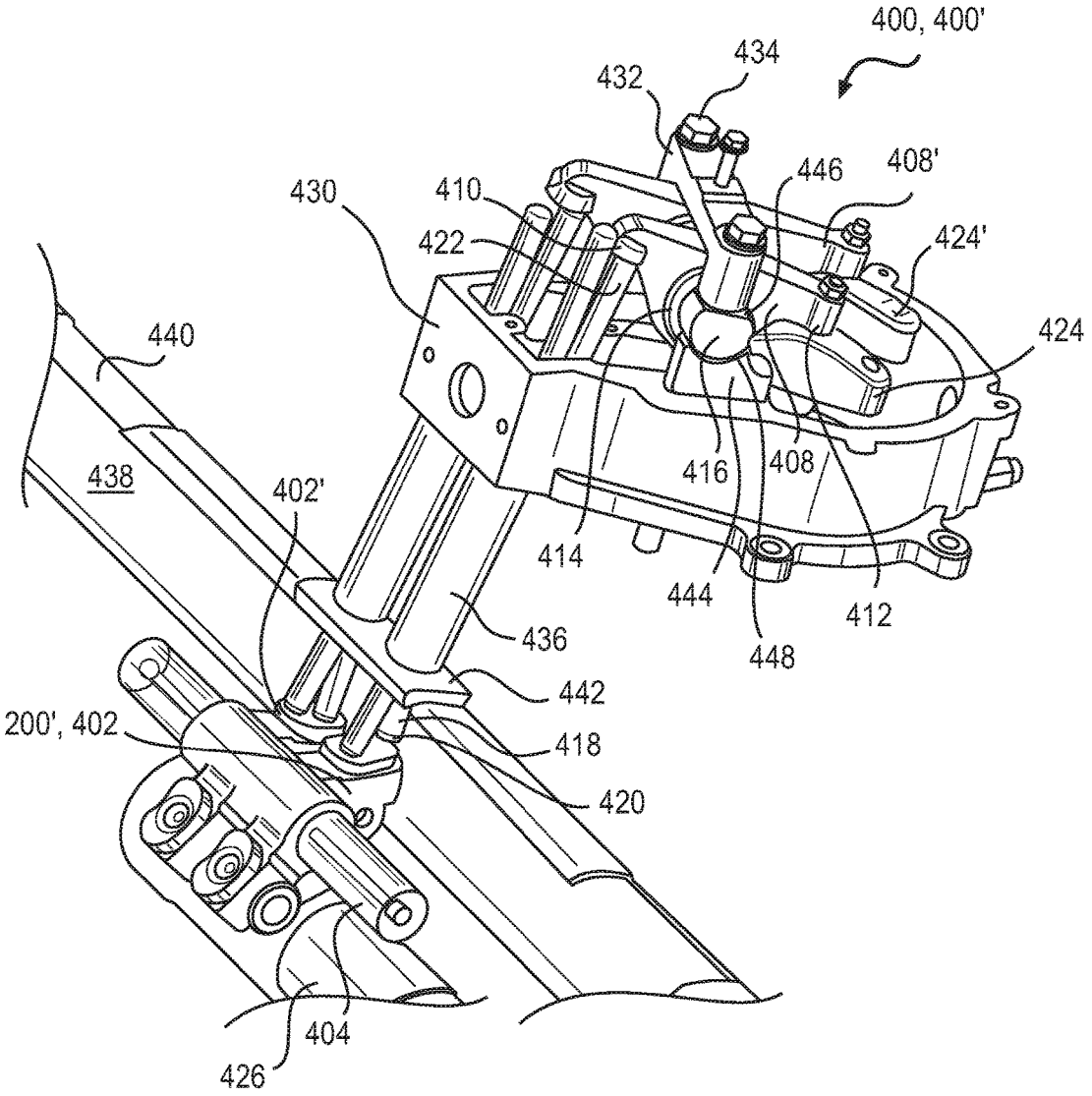
FIG. 5 is a perspective view of a valve train assembly used in an engine employing the rocker arm of FIG. 1.
Figure 6:
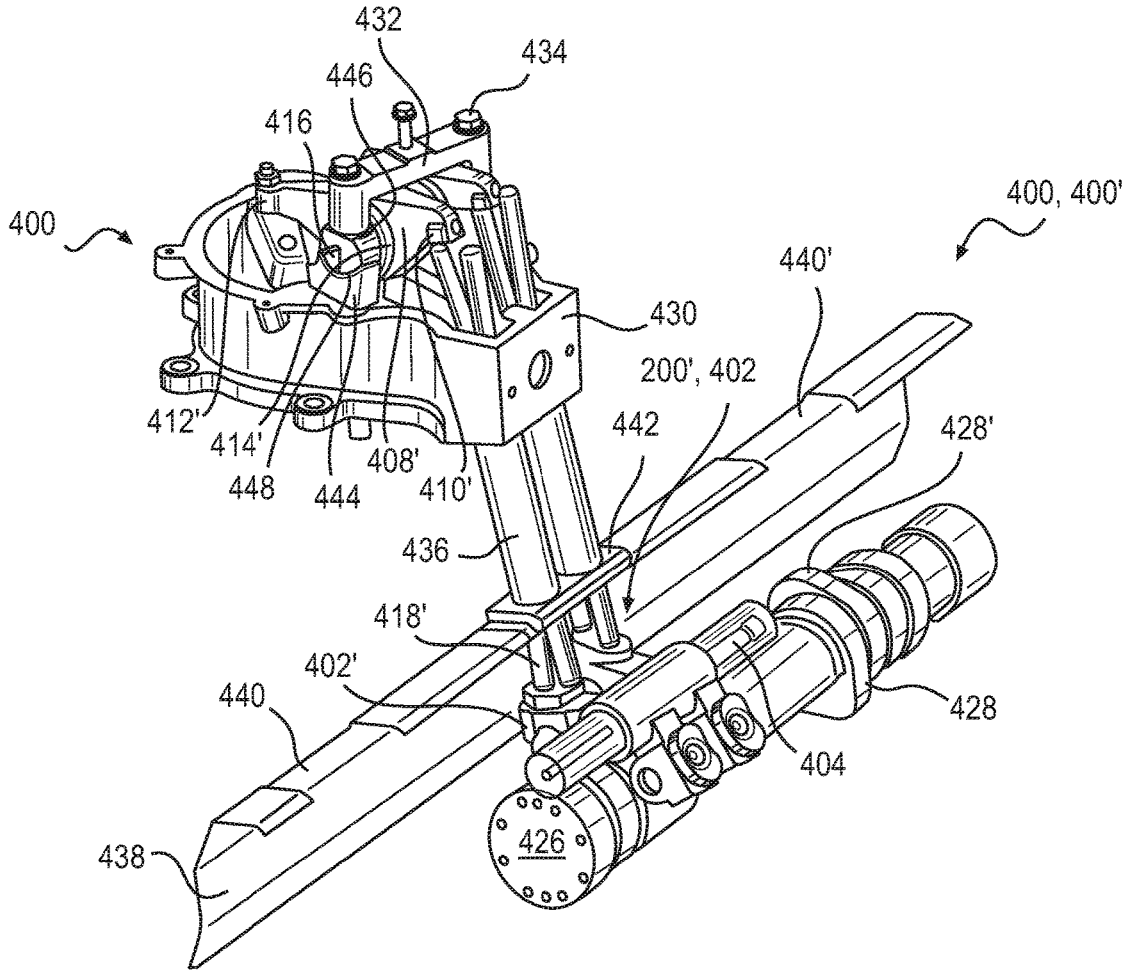
FIG. 6 is an alternate perspective view of the valve train assembly of FIG. 5.

Referring now to FIGS. 5 and 6, a valve train assembly 400 that may use a rocker arm 200 such as that just described with reference to FIGS. 1 thru 4 is shown. The valve train assembly 400 may comprise a cam follower rocker arm 402 similarly or identically configured to the rocker arm 200 just described.

Accordingly, as best seen in FIGS. 1, 3 and 4, the cam follower rocker arm 402 (may also be referred to as the lower rocker arm) may include a body 202 that comprises a large eye portion 246 defining a pivot aperture 204 and a pad 206 spaced away from the pivot aperture 204 a predetermined distance 208, and a small eye portion 248 disposed underneath the pad 206, defining a roller aperture 250 as previously described. The pad 206 may include a peripheral surface 210 and a top surface 212 that defines a blind aperture 214 and the top surface 212 includes one or more aligning features 216 disposed around or near the blind aperture 214. The pad 206 includes an oblong or elliptical shape with a major axis 238 and a minor axis 240, the pivot aperture 204 defines a pivot axis 242 that is parallel with the minor axis 240 and the major axis 238 is perpendicular to the pivot axis 242, and the pad 206 defines a maximum width 244 measured along the major axis 238 and the blind aperture 214 defines a diameter D214 measured along the major axis 238 and the ratio of the maximum width 244 to the diameter D214 may range from 2.3 to 2.9.

Looking back at FIGS. 5 and 6, a first shaft 404 (may be referred to as a lower shaft) is disposed in the pivot aperture 204 of the rocker arm 200. Similarly, the valve train assembly 400 may further comprise a roller 406 disposed in the roller aperture 250 of the rocker arm (see FIGS. 7 and 8). Returning to FIGS. 5 and 6, an overhead follower rocker arm 408 (may be referred to as an upper rocker arm) may also be provided including a first end 410, a second end 412, and a pivot feature 414 located between the first end 410 and the second end 412. A second shaft 416 (may also be referred to as an upper shaft) engages the pivot feature 414 of the overhead follower rocker arm 408, and more particularly, may be inserted into the pivot feature 414 of the overhead follower rocker arm 408. The overhead follower rocker arm 408 is differently configured as compared to the cam follower rocker arm 402 but it is contemplated that it could have a similar or identical configuration to the cam follower rocker arm 402 in other embodiments. More specifically, the overhead follower rocker arm could have a pad that is similarly or identically constructed with aligning features as has been already described with reference to the cam follower rocker arm.

The valve train assembly 400 may further include a pushrod 418 including a bottom end 420 engaging the pad 206 of the cam follower rocker arm 402 and a top end 422 engaging the first end of the overhead follower rocker arm. A valve bridge assembly 424 may also be provided engaging the second end 412 of the overhead follower rocker arm 408. Though not clearly shown, the valve bridge assembly 424 is operatively connected to a valve member such that movement of the overhead follower rocker arm 408 will open and close the valve member at the appropriate time. As can be seen, there are two such valve bridge assemblies 424, 424' adjacent each other that have adjacent overhead follower rocker arms 408, 408' that rock back and forth at different times so as one valve bridge assembly is in an open configuration, that is to say, the valve member associated with that valve bridge assembly is an open configuration to allow the ingress or egress of gases, the other valve bridge assembly is in a closed configuration.

In order to cause the movement of the valve bridge assemblies 424, the valve train assembly 400 further comprises a cam shaft 426 engaging the roller 406 disposed in the roller aperture of the cam follower rocker arm 402. As the cam shaft 426 rotates, a lobe 428 of the cam shaft 426 will contact the cam follower rocker arm 402 of one valve train assembly 400, causing that pushrod 418 to move upwards, creating the rocking motion of the associated overhead follower rocker arm 402, opening the appropriate valve. As the cam shaft 426 continues to rotate, the lobe 428 passes the cam follower rocker arm 402 allowing the valve to close. Eventually, another lobe 428' of the cam shaft 426 contacts the adjacent cam follower rocker arm 402', causing the adjacent valve train assembly 400' to move and open another valve at the appropriate time.

As also shown in FIGS. 5 and 6, the valve train assembly 400 further comprises a cylinder head 430 and a rocker bridge 432 that is operatively connected to the cylinder head 430 and engages the second shaft 416, holding the second shaft 416 stationary. Though not shown completely, the cylinder head 430 may be attached such as by fastening to the engine block (not shown). More specifically, two bolts 434 are provided that attach the cylinder head 430 to the engine block, holding the cylinder head 430, rocker bridge 432, overhead follower rocker arm 408 and pushrods 418 in place. Furthermore, guide sleeves 436 (may also be referred to as pushrod covers) are provided and each guide sleeve 436 defines a guide bore (not shown) and the pushrod 418 is disposed in the guide bore of the guide sleeve 436. There is clearance between the guide bore and the pushrod, so the guide sleeve only provides minimal alignment.

A sheet metal member 438 is provided, at least partially covering the lower components of the valve train assembly 400 including the cam follower rocker arms 402, first shaft 404, and the cam shaft 426. The sheet metal member 438 defines a plurality of slots 440 strategically positioned over each set of cam follower rocker arms 402. An access cover plate 442 is positioned over the slot 440 and the pushrod 418 extends through the access cover plate 442, while at the same time, the guide sleeve 436 is positioned between the access cover plate 442 and the cylinder head 430.

During assembly, the pushrod 418 is inserted into the guide sleeve 436 until it engages the aligning features of the pad of the cam follower rocker arm 402. Then, the overhead follower rocker arm 408 and the second shaft 416 are positioned properly so that the pushrods 418 are properly engaging the overhead follower rocker arms 408 and the second shaft 416 is sitting on a bearing member 444 sandwiched between the cylinder head 430 and second shaft 416. As the bolts 434 are torqued to the specified setting, the rocker bridge 432 presses on the flat portions 446 of the second shaft 416, which in turn causes the second shaft 416 to press on the concave surface 448 of the bearing member 444, which in turn presses down on the cylinder head 430 and engine block.

During the assembly process, if the aligning features are not present on the pad, the pushrod may fall off the pad or may not be seated properly in a retaining feature (such as a blind aperture of the pad). If the pushrod is stuck, the compressive load exerted on the pushrod when the bolts are torqued may bend the pushrod, making the valve train assembly unable to work properly, or may otherwise damage a portion of the rocker arm. By providing the aligning features, dimensions or ratios described herein, the pushrod may be unable to fall off the pad or may be biased into the proper seated position on the pad of the rocker arm as the bolts are torqued, helping to prevent the valve train assembly from malfunctioning. To that end, it may be helpful in certain embodiments if the maximum width 244 of the pad 206 ranges from 70 mm to 80 mm (see FIG. 4) in some embodiments.

It should be noted that in FIGS. 5 thru 8, two positions of the same pushrod are illustrated engaging the pad of the cam follower rocker arm. The purpose of showing these two positions of the pushrod are to illustrate the principles of how proper alignment of the pushrod with respect to a rocker arm is maintained during assembly and operation of the valve train assembly. However, the reader should understand that only one pushrod per rocker arm is actually utilized.

Focusing now on FIGS. 7 and 8, the extreme positions of the pushrod as the cam shaft rotates are depicted. In FIG. 7, the possible extreme left position 450 of the pushrod 418 when the roller 406 is contacting the base circle portion 452 of the cam shaft 426 is limited by the internal bore of the guide sleeve 436 such that bottom end 420 of the pushrod 418 is in contact with the second chamfered surface 230, biasing the pushrod 418 toward the blind aperture 214. On the other hand, the possible extreme right position 454 of the pushrod 418 when the roller 406 is contacting the base circle portion 452 of the cam shaft 426 is limited by the internal bore of the guide sleeve 436 such that the bottom end 420 of the pushrod 418 contacts the first chamfered surface 228 or the radial surface 232, biasing the pushrod 418 toward the blind aperture 214.

Conversely, FIG. 8 shows the possible extreme positions of the pushrod 418 when the lobe 428 of the cam shaft 426 contacts the roller 406. The possible extreme left position 450' of the pushrod 418 in this case is limited by the internal bore of the guide sleeve 436 such that the bottom end 420 of the pushrod 418 is in contact with the first chamfered surface 228 or the radial surface 232, biasing the pushrod 418 toward the blind aperture 214 of the pad 206 of the rocker arm 200, 402. On the other hand, the possible extreme right position 454' is limited by the internal bore of the guide sleeve 436 such that the bottom end 420 of the pushrod 418 contacts the second chamfered surface 230 of the pad 206 of the rocker arm 200', 402, biasing the pushrod 418 toward the blind aperture 214.

Any of the variables, dimensions, configurations of various components or features of those components, ratios etc. discussed herein may vary from what has been specifically mentioned as needed or desired.

INDUSTRIAL APPLICABILITY

In practice, a rocker arm according to any embodiment described herein may be provided, sold, manufactured, and bought etc. to refurbish, retrofit or remanufacture existing valve train assemblies and engines. Similarly, an engine, a valve train assembly or other type of train assembly may also be provided, sold, manufactured, bought, etc. to provide a new apparatus.

FIG. 9 is a flow chart delineating a method of assembly for a valve train assembly or other similar assembly using a rocker arm according to an embodiment of the present disclosure. The method 500 may comprise: engaging a pushrod with an aligning feature of a rocker arm or an aperture of the rocker arm (step 502), and limiting the movement of the pushrod relative to the rocker arm so that the pushrod is always in contact with an aligning feature (step 504). The method may further comprise torquing a fastener operatively associated with the pushrod and the rocker arm to a predetermined threshold without bending the pushrod or forcing the pushrod off the rocker arm (step 506).

In some embodiments, step 504 may include providing a guide sleeve with an internal bore, through which the pushrod passes, limiting the lateral movement of the pushrod (step 508).

In other embodiments, step 504 may include providing a stop feature on the rocker arm around an alignment feature or an aperture of the rocker arm (step 510). The stop feature may be a ridge or the like.

In yet further embodiments, step 504 may be omitted altogether.

It will be appreciated that the foregoing description provides examples of the disclosed assembly and technique. However, it is contemplated that other implementations of the disclosure may differ in detail from the foregoing examples. All references to the disclosure or examples thereof are intended to reference the particular example being discussed at that point and are not intended to imply any limitation as to the scope of the disclosure more generally. All language of distinction and disparagement with respect to certain features is intended to indicate a lack of preference for those features, but not to exclude such from the scope of the disclosure entirely unless otherwise indicated.

Recitation of ranges of values herein are merely intended to serve as a shorthand method of referring individually to each separate value falling within the range, unless otherwise indicated herein, and each separate value is incorporated into the specification as if it were individually recited herein.

It will be apparent to those skilled in the art that various modifications and variations can be made to the embodiments of the apparatus and methods of assembly as discussed herein without departing from the scope or spirit of the invention(s). Other embodiments of this disclosure will be apparent to those skilled in the art from consideration of the specification and practice of the various embodiments disclosed herein. For example, some of the equipment may be constructed and function differently than what has been described herein and certain steps of any method may be omitted, performed in an order that is different than what has been specifically mentioned or in some cases performed simultaneously or in sub-steps. Furthermore, variations or modifications to certain aspects or features of various embodiments may be made to create further embodiments and features and aspects of various embodiments may be added to or substituted for other features or aspects of other embodiments in order to provide still further embodiments.

Accordingly, this disclosure includes all modifications and equivalents of the subject matter recited in the claims appended hereto as permitted by applicable law. Moreover, any combination of the above-described elements in all possible variations thereof is encompassed by the disclosure unless otherwise indicated herein or otherwise clearly contradicted by context.

What is claimed is:

1. A rocker arm for use with a valve train assembly of an engine, the rocker arm comprising:

a body defining a pivot aperture and including a raised pad spaced away from the pivot aperture a predetermined distance; and the raised pad is defined by a top surface that defines a blind aperture with a bottom and the raised pad is further defined by a side surface extending perpendicularly to the top surface, the blind aperture forming an intersection with the top surface, and the top surface includes a plurality of aligning surfaces disposed around the blind aperture and the plurality of aligning surfaces extend to the side surface;

wherein the raised pad includes an oblong shape with a major axis and a minor axis, the pivot aperture defines a pivot axis that is parallel with the minor axis and the major axis is perpendicular to the pivot axis, and the raised pad defines a maximum width measured along the major axis and the blind aperture defines a diameter measured along the major axis and the body defines a ratio of the maximum width to the diameter ranging from 2.3 to 2.9.

2. The rocker arm of claim 1, wherein the raised pad further includes a bottom flat surface disposed at the bottom of the blind aperture and a cylindrical sidewall extending from the bottom flat surface to the top surface of the raised pad.

3. The rocker arm of claim 1, wherein the raised pad includes a concave surface defining the blind aperture.

4. The rocker arm of claim 1, wherein the blind aperture defines a perimeter at the intersection of the blind aperture with the top surface of the raised pad and the plurality of aligning surfaces includes a first chamfered surface extending from the perimeter of the blind aperture towards the side surface of the raised pad.

5. The rocker arm of claim 4, wherein the plurality of aligning surfaces further includes a second chamfered surface extending substantially from the side surface of the raised pad toward the first chamfered surface, forming an oblique angle with the first chamfered surface.

6. The rocker arm of claim 5, wherein the plurality of aligning surfaces includes a radial surface transitioning from the first chamfered surface to the second chamfered surface.

7. The rocker arm of claim 1, further comprising a large eye portion defining the pivot aperture and a small eye portion disposed underneath the raised pad, the small eye portion defining a roller aperture.

8. A valve train assembly comprising:

a cam follower rocker arm including a body that comprises a large eye portion defining a pivot aperture and a pad spaced away from the pivot aperture a predetermined distance, a small eye portion disposed underneath the pad, the small eye portion defining a roller aperture;

wherein the pad includes a peripheral surface and a top surface that defines a blind aperture, the blind aperture forming an intersection with the top surface, and the top surface includes at least one aligning surface disposed around the blind aperture, and the pad includes an oblong shape with a major axis and a minor axis, the pivot aperture defines a pivot axis that is parallel with the minor axis and the major axis is perpendicular to the pivot axis, and the pad defines a maximum width measured along the major axis and the blind aperture defines a diameter measured along the major axis and the body defines a ratio of the maximum width to the diameter ranging from 2.3 to 2.9;

a first shaft disposed in the pivot aperture;

a roller disposed in the roller aperture;

an overhead follower rocker arm including a first end, a second end, and a pivot hole located between the first end and the second end;

a second shaft engaging the pivot hole of the overhead follower rocker arm;

a pushrod including a bottom end engaging the pad and a top end engaging the first end of the overhead follower rocker arm; and a valve bridge assembly engaging the second end of the overhead follower rocker arm.

9. The valve train assembly of claim 8, further comprising a cam shaft engaging the roller disposed in the roller aperture of the cam follower rocker arm.

10. The valve train assembly of claim 9, further comprising a cylinder head and a rocker bridge that is operatively connected to the cylinder head, the rocker bridge also engaging the second shaft, holding the second shaft stationary.

11. The valve train assembly of claim 10, further comprising a guide sleeve defining a guide bore and the pushrod is disposed in the guide bore of the guide sleeve.

12. The valve train assembly of claim 11, further comprising a sheet metal member defining a slot and an access cover plate positioned over the slot and the pushrod extends through the access cover plate.

13. The valve train assembly of claim 12, wherein the blind aperture defines a perimeter at the intersection of the blind aperture with the top surface of the pad and the cam follower rocker arm includes a plurality of aligning surfaces including a first chamfered surface extending from the perimeter of the blind aperture towards the peripheral surface of the pad.

14. The valve train assembly of claim 13, wherein the plurality of aligning surfaces further includes a second chamfered surface extending substantially from the peripheral surface of the pad toward the first chamfered surface, forming an oblique angle with the first chamfered surface.

15. The valve train assembly of claim 14, wherein the plurality of aligning surfaces includes a radial surface transitioning from the first chamfered surface to the second chamfered surface.

16. The valve train assembly of claim 12, further comprising a bearing member disposed between the second shaft and the cylinder head.

17. The valve train assembly of claim 8, wherein the maximum width ranges from 70 mm to 80 mm.

* * * * *